United States Patent [19]

Labrum

[11] Patent Number: 5,011,204

[45] Date of Patent: Apr. 30, 1991

[54] RESILIENT DOOR KNOB

[76] Inventor: Randall C. Labrum, 2862 Via del Alazan, Bonita, Calif. 92002

[21] Appl. No.: 516,806

[22] Filed: Apr. 30, 1990

[51] Int. Cl.[5] ..... E05C 21/02

[52] U.S. Cl. ..... 292/347; 292/DIG. 8; 292/DIG. 38

[58] Field of Search ..... 292/170, 336.3, 347, 292/DIG. 8, DIG. 19, DIG. 38

[56] References Cited

U.S. PATENT DOCUMENTS

| | | | |
|---|---|---|---|
| 118,063 | 8/1871 | Smart | 292/DIG. 8 X |
| 2,125,783 | 8/1938 | Heeman | 292/DIG. 8 X |
| 2,131,067 | 9/1938 | Paden | 292/DIG. 8 X |
| 2,149,375 | 3/1939 | Wiebe | 292/DIG. 8 X |
| 2,690,924 | 10/1954 | Johnston | 292/347 |
| 3,490,803 | 1/1970 | Rollins | 292/170 |
| 4,159,837 | 7/1979 | Morita | 292/DIG. 19 X |

*Primary Examiner*—Richard E. Moore
*Attorney, Agent, or Firm*—Ralph S. Branscomb

[57] ABSTRACT

A resilient door knob utilizes both a spring-loaded internal housing and a resilient foam knob so that the doorknob absorbs shock when the door is swung against a wall, or someone strikes the doorknob. Another important feature is that the knob comes in sets of knobs of different colors or configurations such that one knob can be pulled off (or slit of if necessary) of the shaft housing and replaced with another one of a different color in the event, for example, the room is re-painted.

7 Claims, 1 Drawing Sheet

FIG. 1

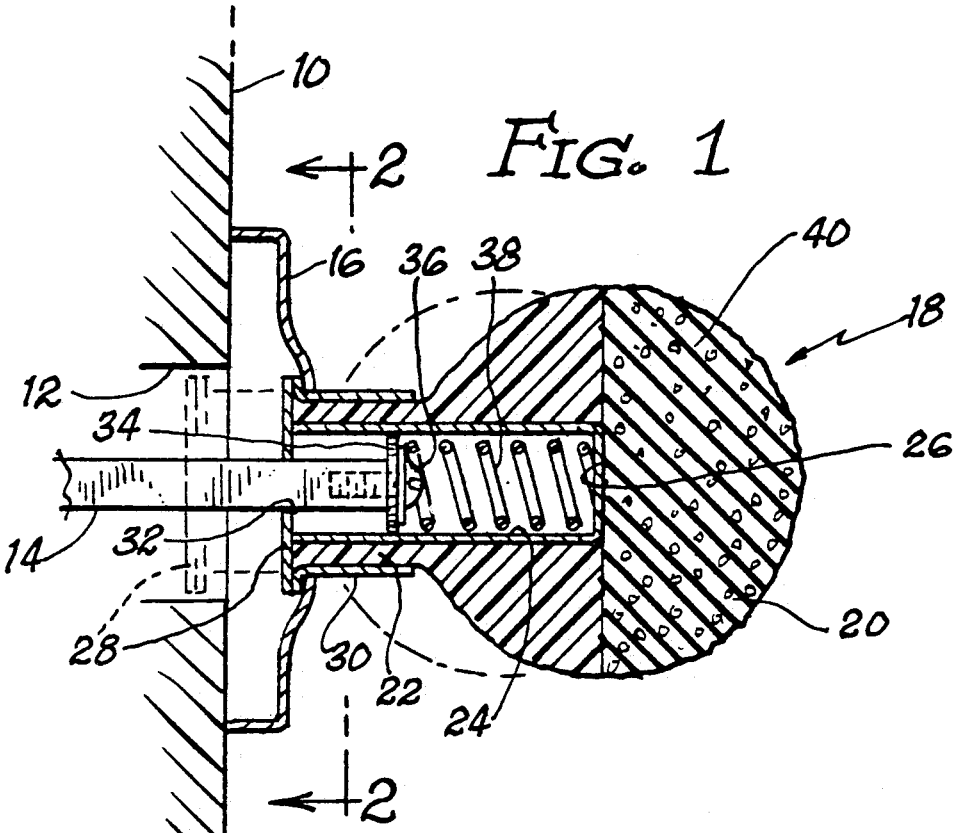
FIG. 1
FIG. 2
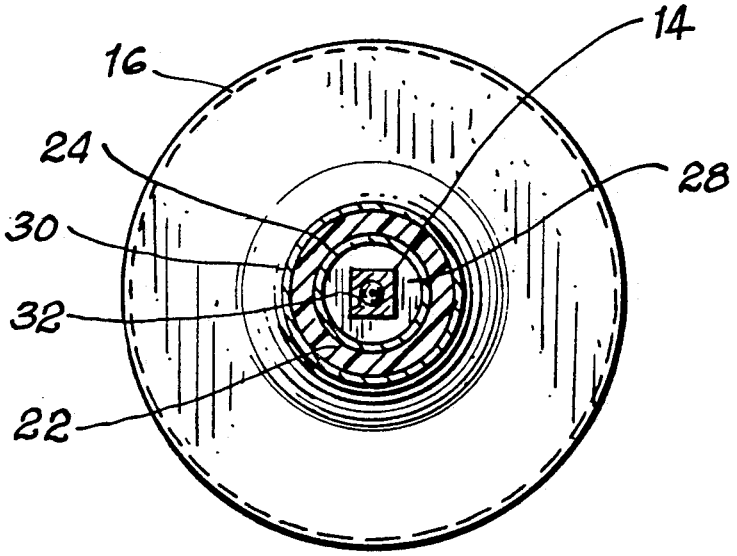

RESILIENT DOOR KNOB

BACKGROUND OF THE INVENTION

Several different kinds of door stops are available on the market. Typically, a doorstop is screwed into the baseboard of the wall, in the appropriate position such that when the door swings open, it strikes the doorstop rather than the wall. Without the use of a doorstop, the doorknob will chip the wall, and then dent, and probably eventually knock a hole through it.

Doorstops are certainly better than having a traditional doorknob impact the wall. However, they tend to be slightly unsightly, and to get in the way, and additionally are not particularly resilient. A typical doorstop has only a half inch or so of relatively hard rubber to absorb the impact of a door. Thus, if the door is repeatedly swung open and impacts the doorstop, it is hard on both the door and the baseboard on which the doorstop is mounted.

Because installation of the doorstop is almost always responsive to the doorknob impact problem, if the doorknob were made in such a way that there would be no damaging impact against the wall, there would be no need for a doorstop.

There is thus a need for a doorknob that is itself resilient, and will absorb the impact of striking against a wall, without damaging the wall, the door, or the doorknob.

In addition, currently bright colors are being used extensively in architecture and in interior decorating, not to mention clothing. Bright colors are in vogue. But traditional doorknobs are typically neutral, so that they will match, or at least not conflict with, the decor of any room.

It would be handy if a doorknob were available which could be changed in color or configuration or style by merely slipping the knob portion off of the relatively expensive remainder of the structure, and slipping on a doorknob of a different color or style.

SUMMARY OF THE INVENTION

The instant invention fulfills the above stated need by providing an easily replaceable knob in a resilient doorknob assembly. The knob is a softer, warmer material than conventional metal doorknobs. It is preferable from the human engineering standpoint in it is much more forgiving when struck with elbows and the like, and it is much more "warm and friendly" to the touch and grasp. It is easier to grip, and is safer, for the same reasons. A doorknob is a projection, and like any other projection, is run into by, and snags, people from time to time.

The doorknob assembly comprises a bulbous foam doorknob portion with a shank which engages over the square shaft that rotates to open the latch of the door. The shank fits around a cylindrical housing, which slidably engages the square shaft so that the knob may move in and out, toward or away from, the door on the square shaft. A coil spring or other bias means pushes the doorknob out, so that the spring absorbs the shock as the doorknob is pushed in the event it strikes a wall.

For additional resilience, at least the outer portion of the bulbous doorknob is made of shock-absorbing, resilient foam. The knob is molded of an attractively colored material and textured to resemble leather or the like, or it could be covered with vinyl or other decorative material. Either way, it is provided in a number of colors, so that any one knob is one of a set of knobs of different colors or configurations, so that colors and styles can be changed at will by the building residents.

BRIEF DESCRIPTION OF THE DRAWINGS

FIG. 1 is a vertical section taken through the doorknob assembly; and

FIG. 2 is a section taken along line 2—2 of FIG. 1.

DETAILED DESCRIPTION OF THE PREFERRED EMBODIMENT

A typical door surface is shown at 10. In the latch area the door has a transverse bore 12 and a square shaft 14 which passes generally axially through the bore. The shaft engages the latch mechanism which is not shown. Rotation of the shaft in either direction from its neutral position will pull the latch element back and permit the door to open. Because the bore 12 is rather rough, doorknob and latch elements almost always have a cover plate 16 which is provided largely for cosmetic purposes.

The instant invention comprises a bulb assembly 18 which consists of a bulbous bulb portion 20, and a shank 22 extending towards the door from the bulbous portion.

Inside the shank and the inner portion of the doorknob bulb is a cylindrical housing 24 having an endwall 26. This housing slips over the projecting end of the square shaft 14.

In order to stabilize the doorknob assembly on the shaft, a first plate 28 is preferably mounted to both the cylindrical housing 24 and to a cylindrical ferrule 30, which defines, with housing 24, a cylindrical slot which seats the shank 22 of the doorknob, so that the whole assembly can be taken apart by removing, or at least loosening, the cover plate 16, and pulling the shank free of the cylindrical housing 24.

The first plate 28 has a square hole 32 so that when it rotates, the shaft 14 rotates. It also defines an outer limit beyond which the doorknob cannot be pulled.

A second circular plate 34 is mounted by a screw 36 to the end of the shaft 14. This plate captures an internally housed coil spring 38, which is compressed between the plate and the endwall 26 of the housing. Between the two plates 28 and 34, the knob is stabilized and the shaft is engaged for twisting.

In the preferred embodiment, the bulbous portion 22 of the knob assembly is constructed of a relatively high-density foam material. The foam would be molded with a textured surface 42 to resemble cowhide or some or some other attractive texture, and the material from which the knob is made would be a decorative color.

As an alternative, the knob could be made of other material, but have an outer hemisphere 40 of impact-absorbing, resilient, foam. The knob could then covered with Vinyl or other attractive, decorative material.

Thus, when the end of the doorknob is impacted in the direction of the door, such as when the door is slammed against the wall adjacent to where the door is hinged, the knob will both compress against the spring 38, and the resilient knob will absorb impact, such that no damage will be done to anything. If the decor is changed, it is a simple matter of removing the doorknob from the housing 24, replacing it with a knob of different color or style.

It is hereby claimed:

1. A resilient doorknob assembly for engaging the doorlatch structure of a door having a transverse shaft which operates a latch element when rotated, said doorknob comprising:

(a) a knob body;

(b) a shaft mounting which mounts said knob body and slidably engages said shaft in operation;

(c) limit means defining limits to the travel of said knob body as it travels toward and away from said door; and (d) bias means biasing said knob body away from said door such that upon said doorknob impacting an obstacle, it will yield axially on the end of said shaft against said bias means.

2. A resilient doorknob assembly for engaging the doorlatch structure of a door having a transverse shaft which operates a latch element when rotated, said doorknob comprising:

(a) a knob body;

(b) a shaft mounting which mounts said knob body and slidably engages said shaft;

(c) limit means defining limits to the travel of said knob body as it travels toward and away from said door;

(d) bias means biasing said knob body away from said door such that upon said doorknob impacting an obstacle, it will yield axially on the end of said shaft against said bias means; and (e) said shaft mount comprising a longitudinally extended cylindrical housing passing over one end of said shaft and including a first plate fixed to said housing and slidably fitted over said shaft, and a second plate mounted to said shaft and rotatably fitted within said housing, such that said plates define said limit means and cause rotation of said doorknob to rotate said shaft.

3. Structure according to claim 2 wherein said cylindrical housing defines an endwall at the end thereof remote from said door, and said bias means comprises a coil spring captured between second plate and said endwall.

4. Structure according to claim 2 wherein said knob body is frictionally fitted over said cylindrical housing and can be replaced by a similar knob by sliding one off and the other on to said cylindrical housing.

5. Structure according to claim 4 wherein said knob body has a cylindrical shank portion and said first plate is mounted to a cylindrical ferrule and to said cylindrical body, and said shank portion seats between said cylindrical shank portion and said cylindrical housing.

6. A resilient doorknob assembly for engaging the doorlatch structure of a door having a transverse shaft which operates a latch element when rotated, said doorknob comprising:

(a) a knob body;

(b) a shaft mounting which mounts said knob body and slidably engages said shaft;

(c) limit means defining limits to the travel of said knob body as it travels toward and away from said door;

(d) bias means biasing said knob body away from said door such that upon said doorknob impacting an obstacle, it will yield axially on the end of said shaft against said bias means;

(e) said knob body including a bulbous hand-gripped portion in addition to said shank, and at least a portion of said bulbous portion remote from said door comprising a resilient material; and (f) said portion of said bulbous portion remote from said door comprising a hemispherical mass of resilient foam.

7. Structure according to claim 6 wherein said knob body is one of a set of interchangeable replacement knob bodies of different colors and styles.

* * * * *